US005437768A

United States Patent [19]

Smith et al.

[11] Patent Number: 5,437,768

[45] Date of Patent: Aug. 1, 1995

[54] NON-BAFFLED LOW PRESSURE DROP VACUUM COOLED INSERTED SMELT SPOUT

[75] Inventors: J. William Smith, Massillon; Jerry D. Blue, Clinton; Stan Crofut, Massillon; Ed Gayhart, North Canton; Joan Barna, Akron, all of Ohio

[73] Assignee: The Babcock & Wilcox Company, New Orleans, La.

[21] Appl. No.: 144,921

[22] Filed: Oct. 28, 1993

[51] Int. Cl.[6] ..... B22D 35/06; B67D 5/62; D21C 11/12

[52] U.S. Cl. ..... 162/239; 222/592; 222/594; 222/595; 162/240

[58] Field of Search ..... 122/6 A, 4 R, 6.5; 222/590, 591, 592, 594, 595; 162/239, 240, 30.1, 30.11

[56] References Cited

U.S. PATENT DOCUMENTS 4,750,649 6/1988 Fahey et al. ..... 222/592

*Primary Examiner*—Steven Alvo

*Attorney, Agent, or Firm*—Daniel S. Kalka; Robert J. Edwards

[57] ABSTRACT

A spout for channeling smelt from a boiler through an opening in the walls of the boiler comprises a jacket having an inner wall and an outer wall. The outer wall is spaced a distance away from the inner wall and the jacket has one end insertable into the opening of the wall. The jacket defines a trough for carrying smelt from the boiler. An inlet communicates with the jacket for delivering a water flow to the jacket between the inner wall and the outer wall. An O-shaped tube communicates with the jacket at the inserted end of the jacket for receiving the water flow from between the inner wall and the outer wall of the jacket. An outlet communicates with the O-shaped tube near the inserted end for channeling the water flow from the O-shaped tube and out of the spout. A vacuum is used near the outlet for insuring a proper low pressure drop.

5 Claims, 6 Drawing Sheets

NON-BAFFLED LOW PRESSURE DROP VACUUM COOLED INSERTED SMELT SPOUT

BACKGROUND OF THE INVENTION

1. Field of the Invention

The present invention relates in general to smelt spouts, and in particular to a low pressure drop mass flow design smelt spout.

2. Description of the Related Art

Smelt spouts are troughs which serve as a means of egress for pulping chemicals known as smelt from a recovery boiler. In general, the internals of a smelt spout are water cooled to ensure a reasonably long working life.

Modern recovery boilers utilize water cooled tube and membrane walls to serve as the furnace enclosure. Openings for the smelt to exit are created by bending tubes to form smelt openings. In turn, the spout is either attached to the wall at the opening or is inserted into the opening.

Water cooled spouts are classified in two categories; external and inserted. External smelt spouts fit flush against the tube wall outside of the boiler, and smelt must flow over the tube wall opening surface prior to entering the smelt spout. Inserted smelt spouts are inserted and fitted through the wall, thereby covering the tube wall opening and lessening smelt contact with tubes.

The smelt spouts are operated with either pressurized or vacuum water cooling systems. The vacuum system may afford some additional safety in that there is less potential for water leakage which can cause a smelt water reaction which may lead to an explosion. Since an inserted spout has a greater tendency to release water into the furnace if a failure occurs at the inlet end of the spout, it is desirable to operate an insertable type spout in the vacuum mode.

Most existing insertable spouts are of a similar design, and have multiple passes on the water side of the spout that results in relatively high water side pressure drop and creates pockets where non-condensable gases and steam can collect and impede water flow and cooling. The higher pressure drop also means that the spout, to be operated in the vacuum mode, must run at high vacuum, therefore reducing the boiling point of the cooling water and the margin between operating temperature and that which the coolant would otherwise boil.

SUMMARY OF THE INVENTION

The present invention pertains to a low pressure drop insertable smelt spout for channeling smelt from the opening of the walls of a boiler. The low pressure drop insertable spout permits sufficient operating margin for utilization in a vacuum cooling water system.

The present invention comprises a jacket having an inner wall and an outer wall. The outer wall is spaced a distance away from the inner wall; and the jacket has one end insertable into the opening of the wall of a boiler. The jacket defines a trough for carrying smelt from the boiler.

The spout utilizes an inlet which communicates with the jacket for delivering a water flow to the jacket between the inner wall and the outer wall of the jacket. An O-shaped tube communicates with the jacket at the inserted end of the jacket in order to receive the water flow from between the inner wall and the outer wall of the jacket. An outlet communicates with the O-shaped tube near the inserted end of the jacket for channeling the water flow from the O-shaped tube. A vacuum system is used optionally in conjunction with the spout for allowing the water to flow through the jacket from the inlet between the walls of the jacket, and eventually to the O-shaped tube at the inserted end of the jacket.

It is an object of the present invention to provide a smelt spout for a recovery boiler which is inserted into an opening in a wall of the boiler which is more effective than other known smelt spouts.

DESCRIPTION OF THE PREFERRED EMBODIMENTS

Figure 1:
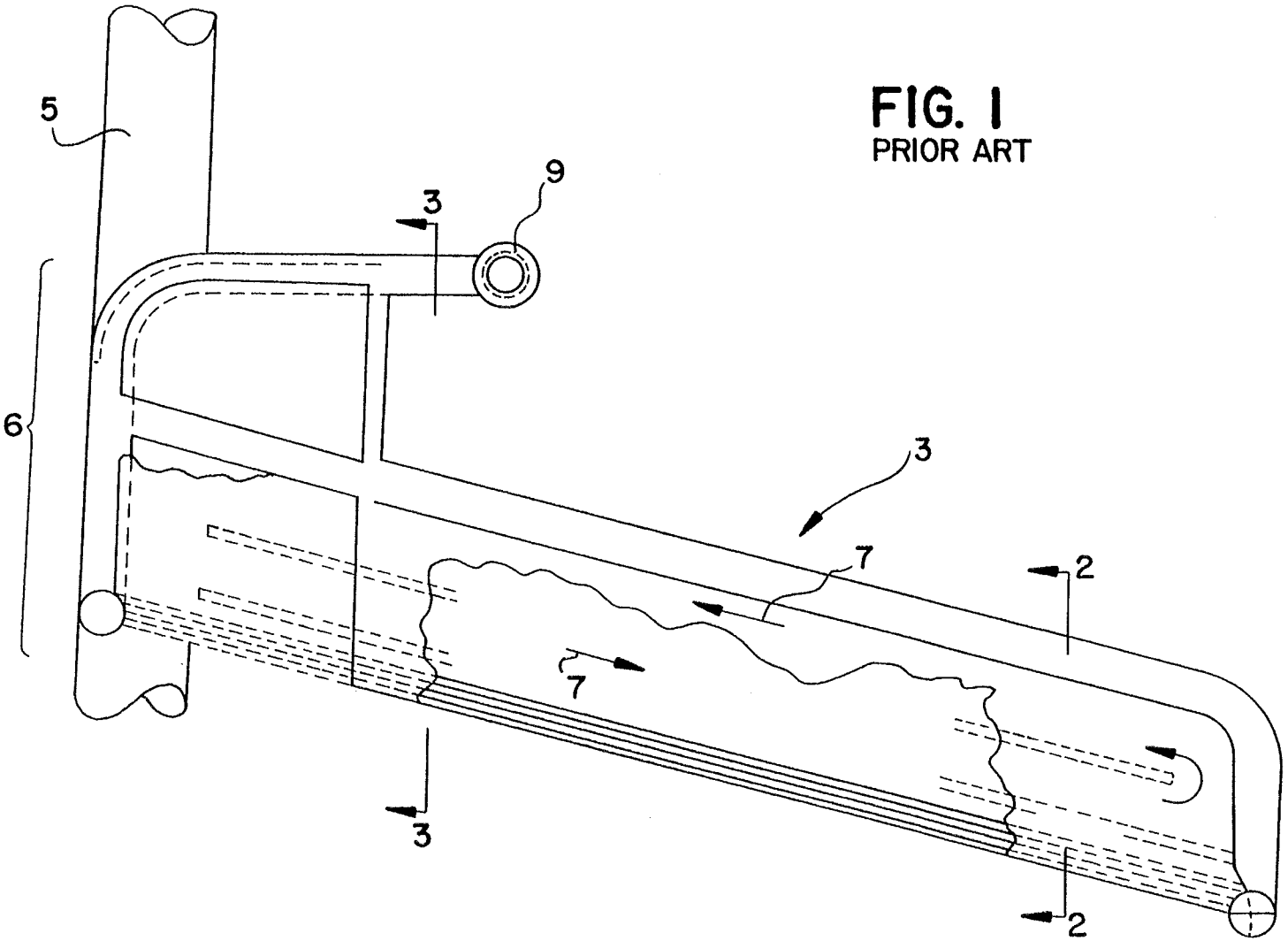
FIG. 1 PRIOR ART
FIG. 1 is a schematic view of a known insertable smelt spout.
Figure 3:
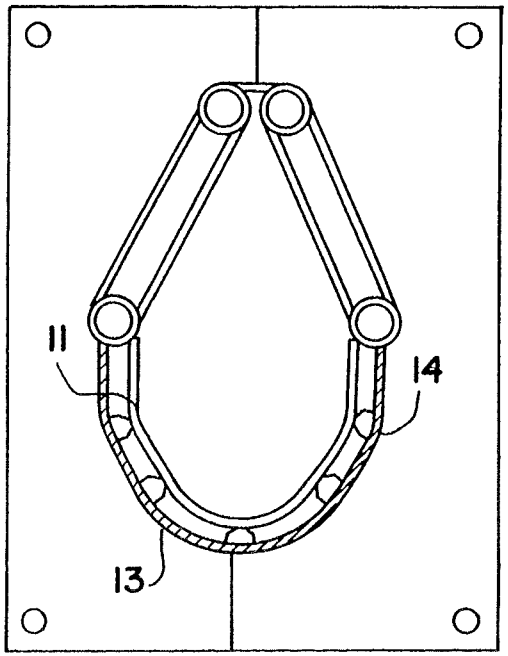
FIG. 3 (PRIOR ART)
FIG. 3 is a view of FIG. 1 taken along line 3—3.

FIG. 1 shows a known inserted smelt spout, generally designated 3, which is inserted into an opening 6 (FIG. 1) of a wall tube 5 for a recovery boiler. The smelt spout 3 has a water inlet 8 and a water outlet 9 for facilitating the flow of water in direction 7 through the spout 3.

Figure 2:
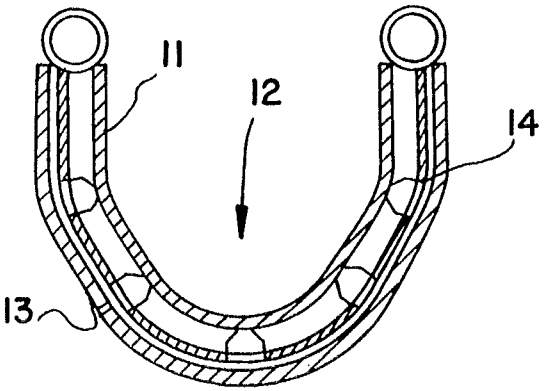
FIG. 2 (PRIOR ART)
FIG. 2 is a view of FIG. 1 taken along line 2—2.

The spout 3 forms trough 12, as shown in FIG. 2, having an outer wall 13 and an inner wall 11 with baffles 14 located between the outer wall 13 and the inner wall 11 of the trough 12.

Figure 5:
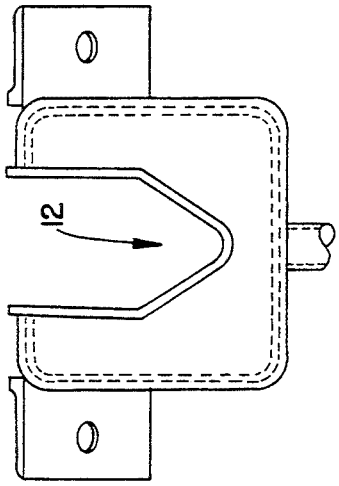
FIG. 5 PRIOR ART
FIG. 5 is a view illustrating a section of FIG. 4.
Figure 4:
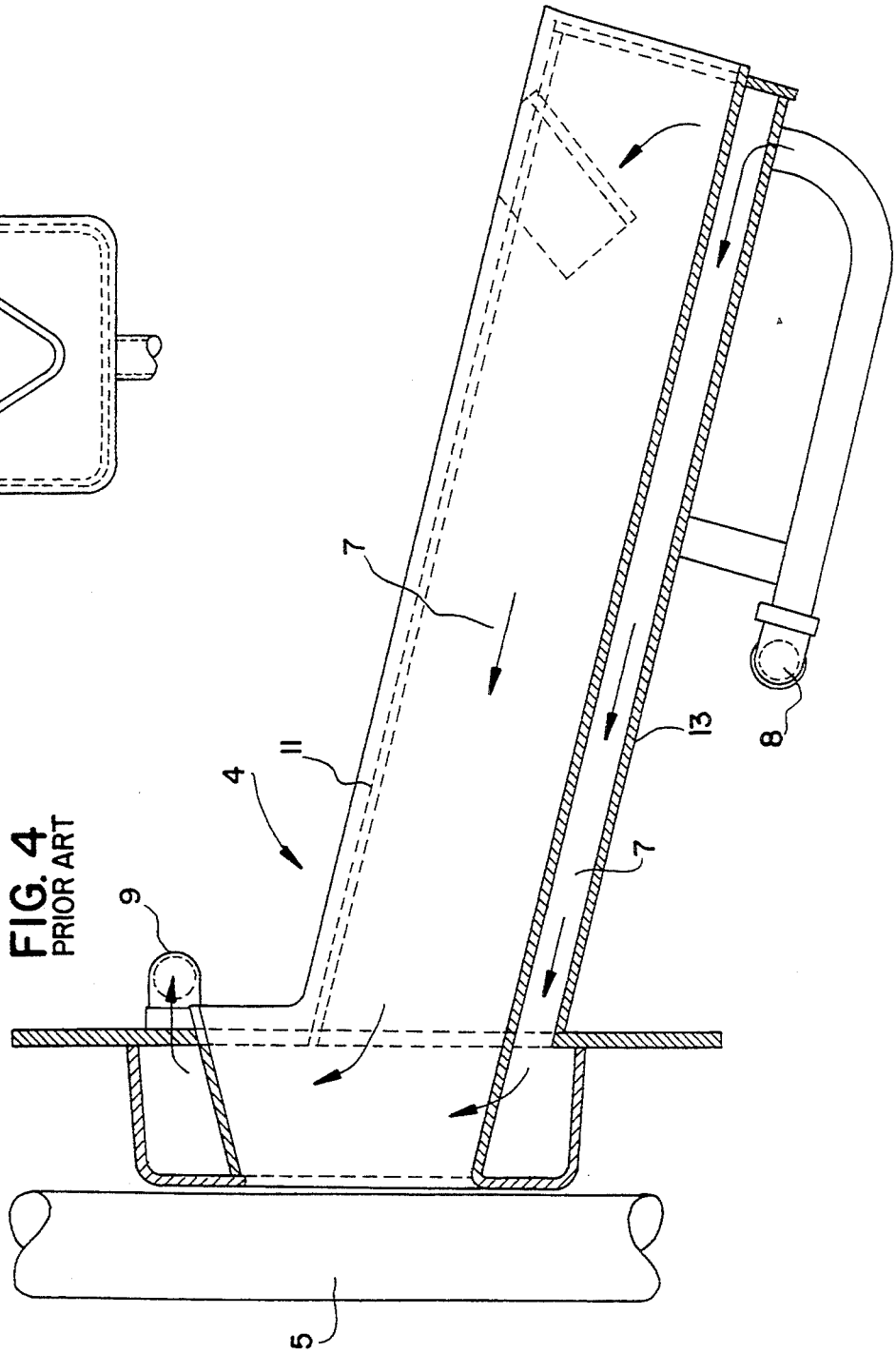
FIG. 4 PRIOR ART
FIG. 4 is a schematic view illustrating a known flush-type smelt spout.

FIG. 4 illustrates a known smelt spout of the flush-type, generally designated 4, which is seated against a wall tube 5 of a recovery boiler. FIG. 5 shows a trough 12 which is essentially a v-shaped example of the flush-type spout 4, shown in FIG. 4.

Figure 6:
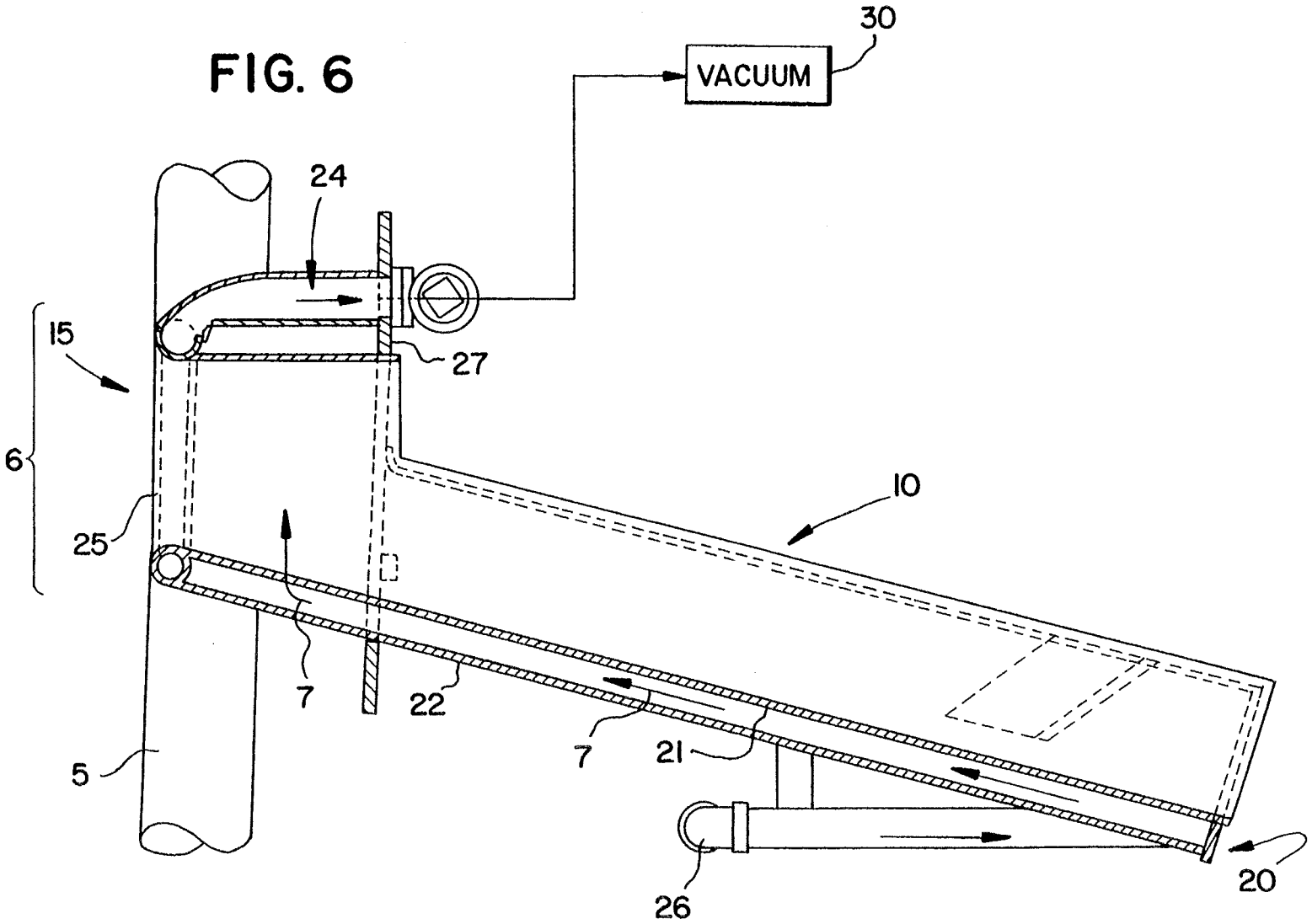
FIG. 6 is a schematic view of a smelt spout according to the present invention.

According to the present invention, as shown in FIG. 6, the present invention comprises an insertable-type smelt spout, generally designated 10, comprising a jacket 20 having an outer wall 22 spaced away from an inner wall 21. Water flow 7 flows between the outer wall 22 and the inner wall 21 of the jacket 20 through the spout 10 to an O-tube 25, which communicates with the jacket 20. The O-tube 25 is located at a front end 15 of the spout 10. The front end 15 is inserted into an opening 6 (FIG. 6) of a wall tube 5 of a recovery boiler. Water 7 is channeled into the spout 10 through inlet 26, between the inner wall 21 and the outer wall 22 of the jacket 20, and in turn to the O-shaped tube 25. A water outlet cavity 24 communicates with the O-shaped tube 25 near the front end 15 of the spout 10. The water outlet 24 allows for water from the O-shaped tube 25 to be channeled from the spout 10. Vacuum means 30 communicates with the spout 10 for insuring that there is low water side pressure. The vacuum 30 is located at the outlet 24 of the spout 10 for providing the most efficient vacuum, which thus, provides an additional safety margin for the design of the spout 10.

Figure 7:
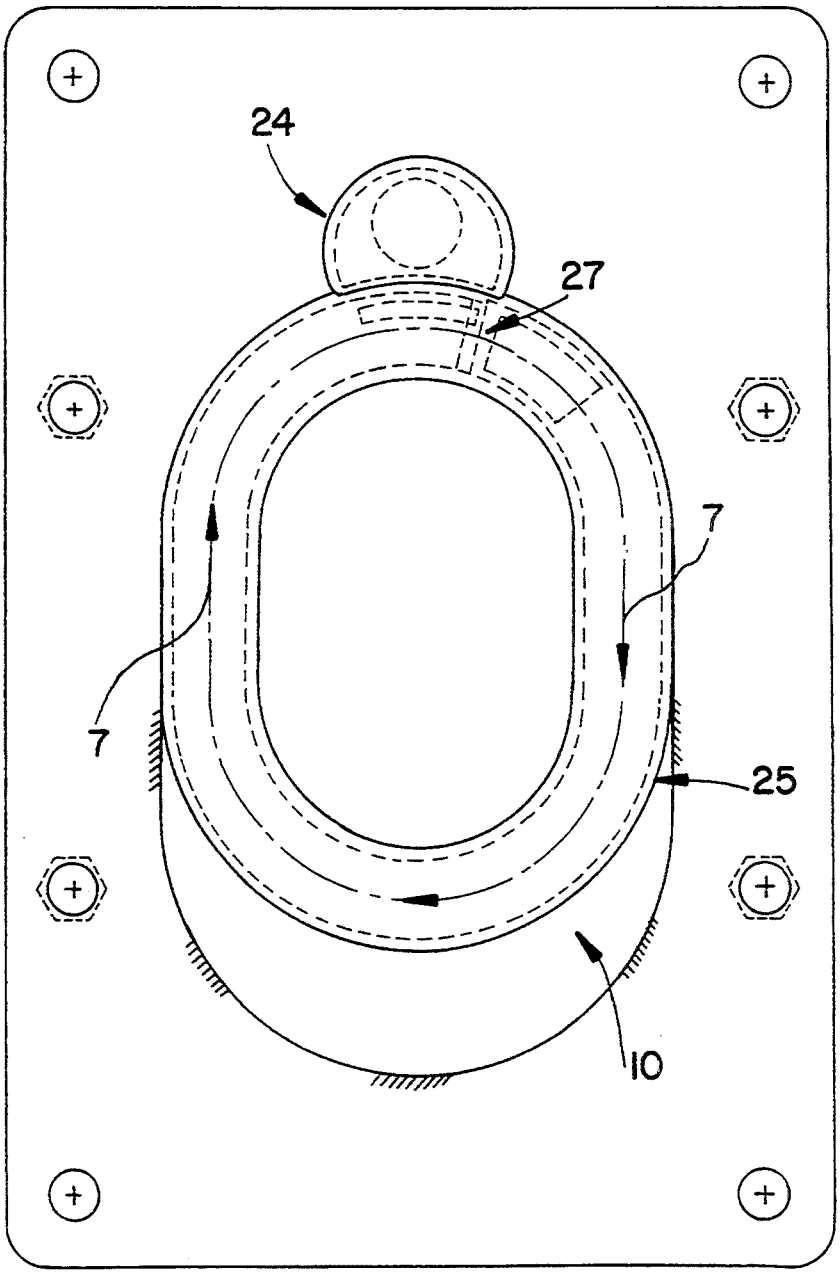
FIG. 7 is a schematic view of a section of FIG. 6.
Figure 8:
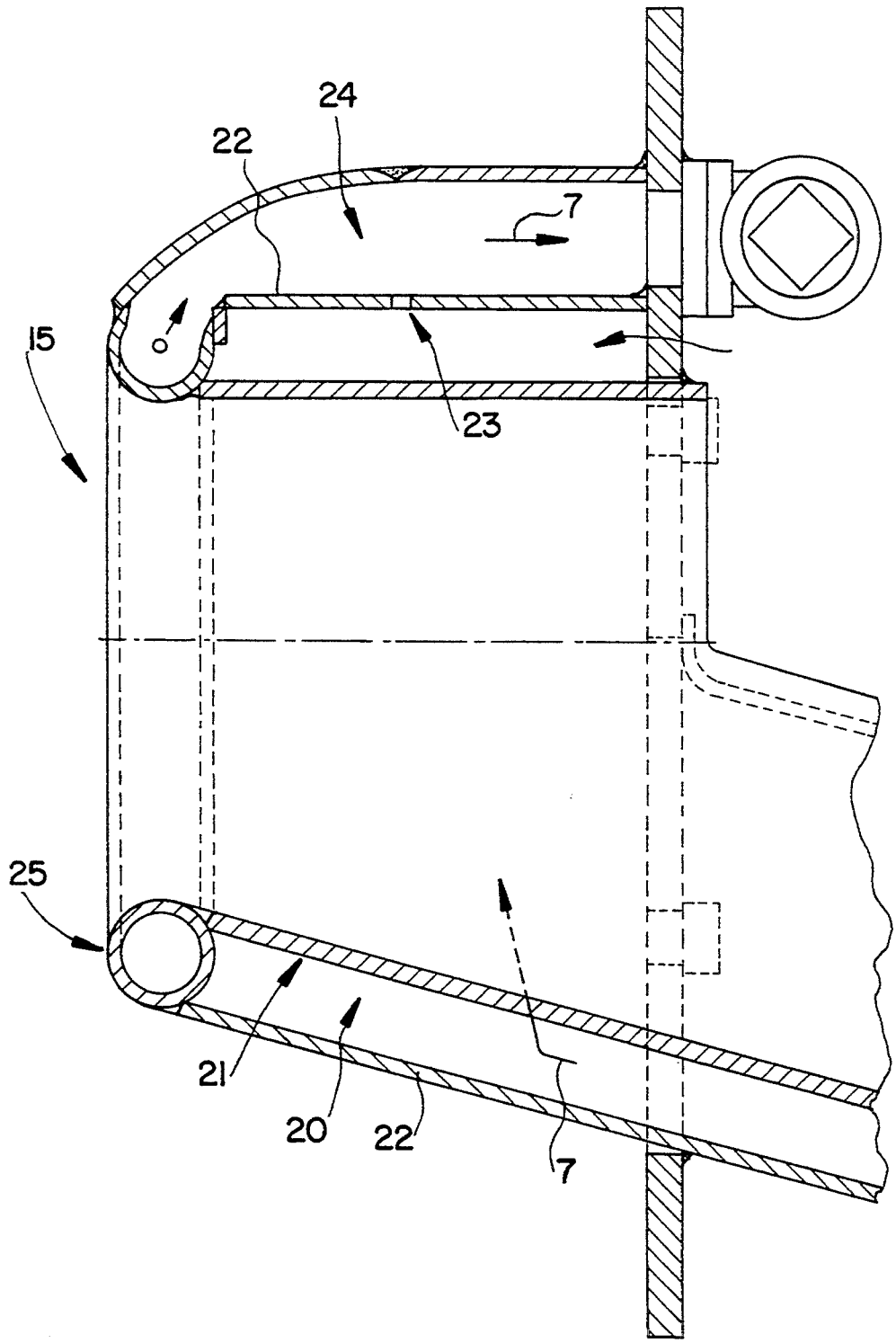
FIG. 8 is a schematic view of a front and of the spout of FIG. 6.

A diaphragm 27, of thin metal, is used to separate O-shaped tube 25 water inlet from the O-shaped tube 25 water outlet as shown in FIG. 7. The spout 10 incorporates a low pressure drop "mass flow" design, and by its unique front end 15 with O-shaped tube 25 and outlet cavity 24, insures proper cooling of the smelt at the "hot end" of the spout 10. The front end 15 is substantially parallel to the wall tube 5 as shown in FIG. 6. FIG. 8 shows a vent hole 23 between the outlet cavity 24 and the outer wall 22 of the jacket 20. The vent hole 23 permits the escape of non-condensable gases from the jacket 20.

FIG. 7 shows the circulation of the water flow 7 through the O-tube 25. After being circulated through the jacket 20 of the spout 10 as shown in FIG. 6, the water flow 7 undergoes a circular flow path through the O-tube 25 as illustrated in FIG. 7 before exiting through the outlet cavity 24.

The present invention using a vacuum cooling water system design provides several advantages. First, the present invention provides a low pressure drop design which is efficient over the known smelt spouts. Second, the present invention has limited passes and provides an arrangement that eliminates or minimizes the cooling water passes.

While a specific embodiment of the invention has been shown and described in detail to illustrate the application of the principles of the invention, it will be understood that the invention may be embodied otherwise without departing from such principles.

What is claimed is:

1. A spout for channeling smelt from a boiler, the boiler having a wall, the wall having an opening, the spout being insertable into the opening of the wall, the spout comprising:

a jacket having an inner wall and outer wall, the outer wall being spaced a distance away from the inner wall, the jacket having one end insertable into the opening of the wall of the boiler, the jacket defining a trough for carrying smelt from the boiler;

an inlet communicating with the jacket for delivering a water flow to the jacket between the inner wall and the outer wall;

an O-shaped tube communicating with the jacket at the one end of the jacket for receiving the water flow from between the inner wall and the outer wall of the jacket, said O-shaped tube having means for separating the inlet and outlet of said O-shaped tube;

an outlet communicating with the O-shaped tube near the one end of the jacket for channeling the water flow from the O-shaped tube, the outlet having a vent hole therein to permit escape of non-condensable gases from the jacket, said outlet being above and along a section of the periphery of the O-shaped tube and structure so that the water circulates from the inlet, around the spout, and out through the outlet; and vacuum means for facilitating the water flow throughout the spout.

2. The spout according to claim 1, wherein the jacket has another end opposite the one end and the inlet is located at the other end of the jacket.

3. The spout according to claim 2, wherein the inlet comprises a tube.

4. The spout according to claim 1, wherein a cavity comprises the outlet.

5. The spout according to claim 1, wherein said means for separating the inlet and outlet of said O-shaped tube comprises a wall.

* * * * *